US006915070B1

(12) United States Patent
Lee

(10) Patent No.: US 6,915,070 B1
(45) Date of Patent: Jul. 5, 2005

(54) QUICK HEATER FOR DRINKING WATER

(76) Inventor: Ming-Tsung Lee, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 10/933,239

(22) Filed: Sep. 3, 2004

(51) Int. Cl.[7] ..... F24H 1/10
(52) U.S. Cl. ..... 392/481; 392/465; 392/479
(58) Field of Search ..... 392/465–482; 99/275, 288, 289 P

(56) References Cited

U.S. PATENT DOCUMENTS 3,711,681 A * 1/1973 Leuschner et al. ..... 392/467
4,095,086 A * 6/1978 Ohnmacht et al. ..... 392/467
4,460,819 A * 7/1984 Eugster ..... 392/484
4,792,661 A * 12/1988 Schmidtchen et al. ..... 392/495
4,825,042 A * 4/1989 Hauslein ..... 392/467
5,367,607 A * 11/1994 Hufnagl et al. ..... 392/465
6,701,068 B2 * 3/2004 Lin ..... 392/480
6,724,985 B2 * 4/2004 Matsunaga et al. ..... 392/480

* cited by examiner

*Primary Examiner*—Thor S. Campbell

(57) ABSTRACT

A quick heater for drinking water includes a helical water pipe defining a narrow space therebetween for fitting an electric heating tube and having a water inlet and a water outlet. The water pipe and the electric heating tube are wrapped up with a support base having its outer side bored with plural holes respectively for the opposite ends of the water pipe and two wire connecting terminals of the electric heating tube to extend out therethrough. The support base has plural lugs at the inner side for support a container with a water intake pipe and a water-releasing pipe, the water intake pipe connected with the water outlet of the water pipe. When cool water gets into the water pipe, it flows circularly therein and is heated by the electric heating tube, and then conveyed to the container for use through the water intake pipe.

3 Claims, 5 Drawing Sheets

QUICK HEATER FOR DRINKING WATER

BACKGROUND OF THE INVENTION

1. Field of the Invention

This invention relates to a quick heater for drinking water, particularly to one provided with a helical water pipe and defining a narrow space between two overlapped pipe portions for an electric heating tube to be fitted therein. The water pipe has its opposite ends respectively formed with a water inlet and a water outlet. After the water pipe and the electric heating tube are combined together, their outer side is wrapped up with a support base that has its outer side bored with two insert holes and two wire terminal holes respectively for the water inlet and the water outlet of the water pipe and two wire terminals of the electric heating tube to extend out therethrough. The support base has its inner annular side provided with plural lugs for supporting and positioning a container thereon. The container is provided with a water intake pipe and a water-releasing pipe, and the water intake pipe is connected with the water outlet of the water pipe. Thus, when water gets into the water pipe through the water inlet, it will flow circularly therein to be heated by the electric heating tube, and then the hot water is conveyed to the container through the water outlet of the water pipe and the water intake pipe of the water container. Thus, a user can get the hot water for use through the water-releasing pipe of the container. Additionally, the boiled water in the container can be kept hot all the time.

2. Description of the Prior Art

In most cases, a teapot is put on a gas stove or an electric heater to have the water inside heated and after the water in the teapot boils, gas or electricity is cut off and hot drinking water is poured out of the teapot for use. However, if the water in the teapot is used up, it is necessary to have the teapot filled with water to be boiled again. In addition, a common teapot is unable to always keep the drinking water hot; therefore, when the water in the teapot cools down, it has to be heated again, thus consuming much time and causing much trouble.

SUMMARY OF THE INVENTION

The objective of the invention is to offer a quick heater for drinking water, not only able to heat drinking water quickly, but also able to keep drinking water hot all the time.

The quick heater for drinking water in the present invention includes a water pipe, an electric heating tube, a support base and a container. The water pipe is made of stainless steel shaped helical and defining a narrow space between two overlapped pipe portions, having one end formed with a water inlet and the other end formed with a water outlet. The electric heating tube is fitted in the narrow space between two pipe bodies, having its opposite ends respectively provided with a wire connecting terminal. The support base is wrapped around the outer side of the combined body of the water pipe and the electric heating tube and has its outer side bored with two insert holes and two wire terminal holes respectively for the water inlet and the water outlet of the water pipe and two wire connecting terminals of the electric heating tube to extend out therethrough. The support base further has its inner annular side provided with plural lugs. The container is positioned on the support base and provided with a water intake pipe and a water-releasing pipe, with the water intake pipe connected with the water outlet of the water pipe.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
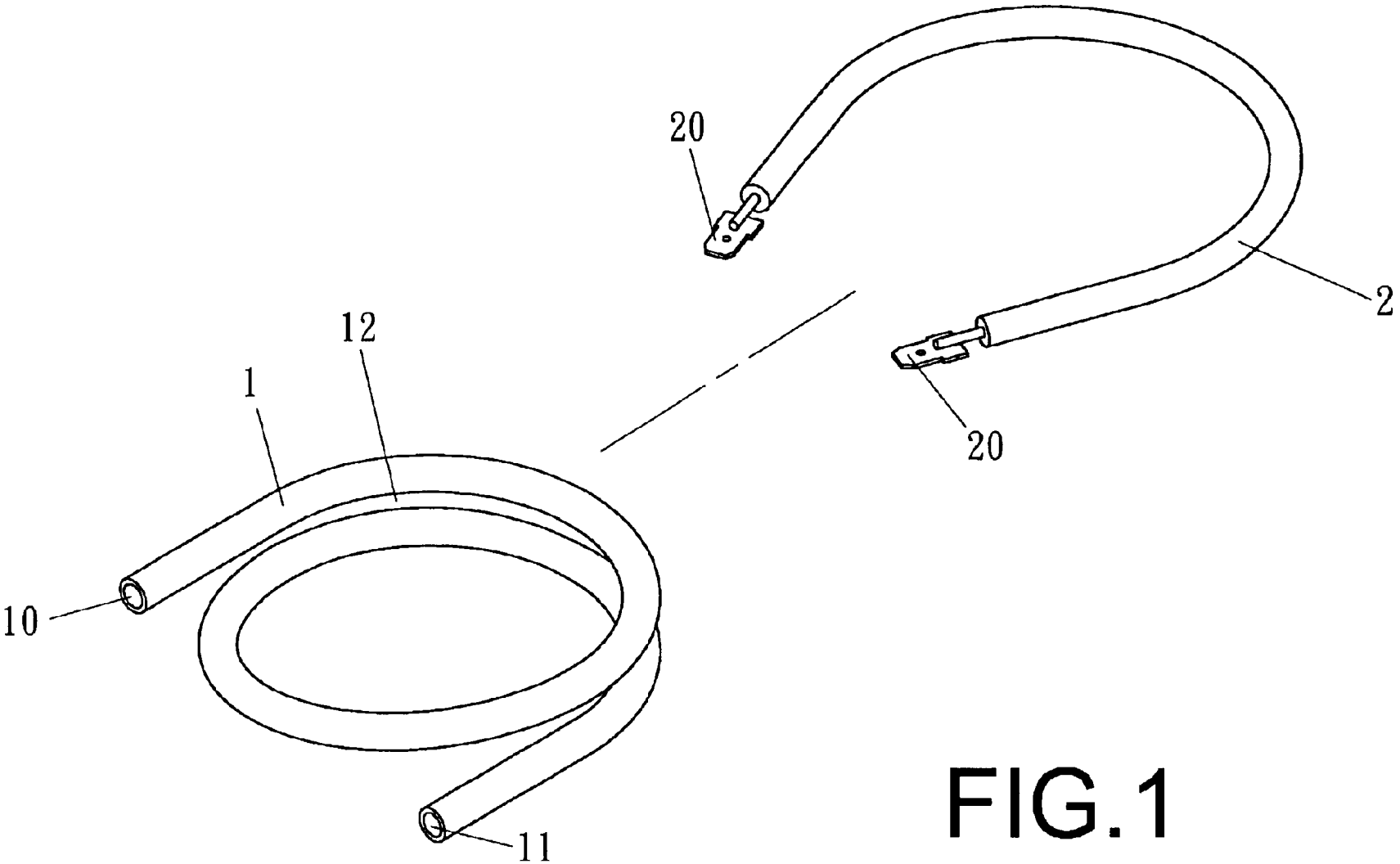
FIG. 1 is a perspective view of a water pipe and an electric heating tube separated from each other in the present invention.
Figure 2:
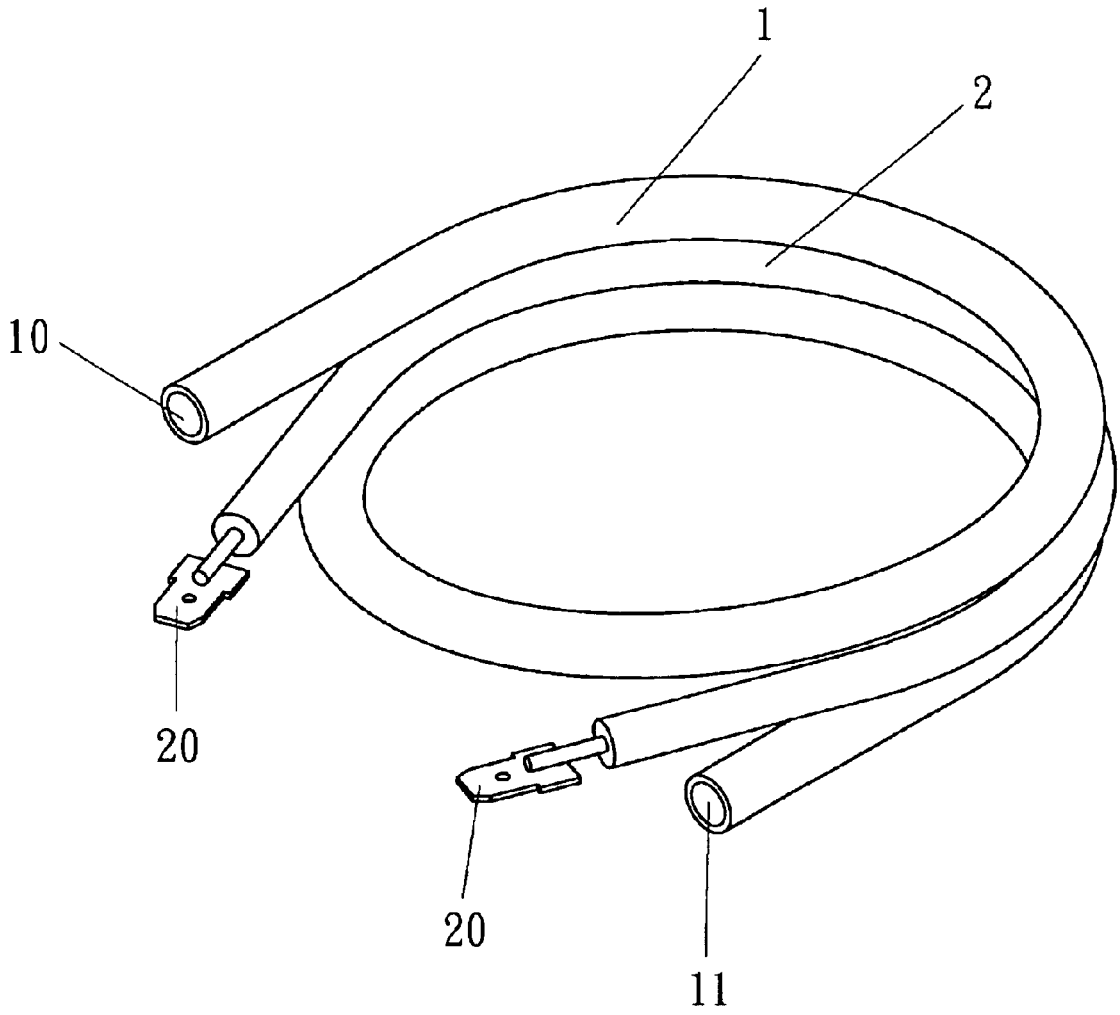
FIG. 2 is a perspective view of the water pipe and the electric heating tube combined together in the present invention.
Figure 3:
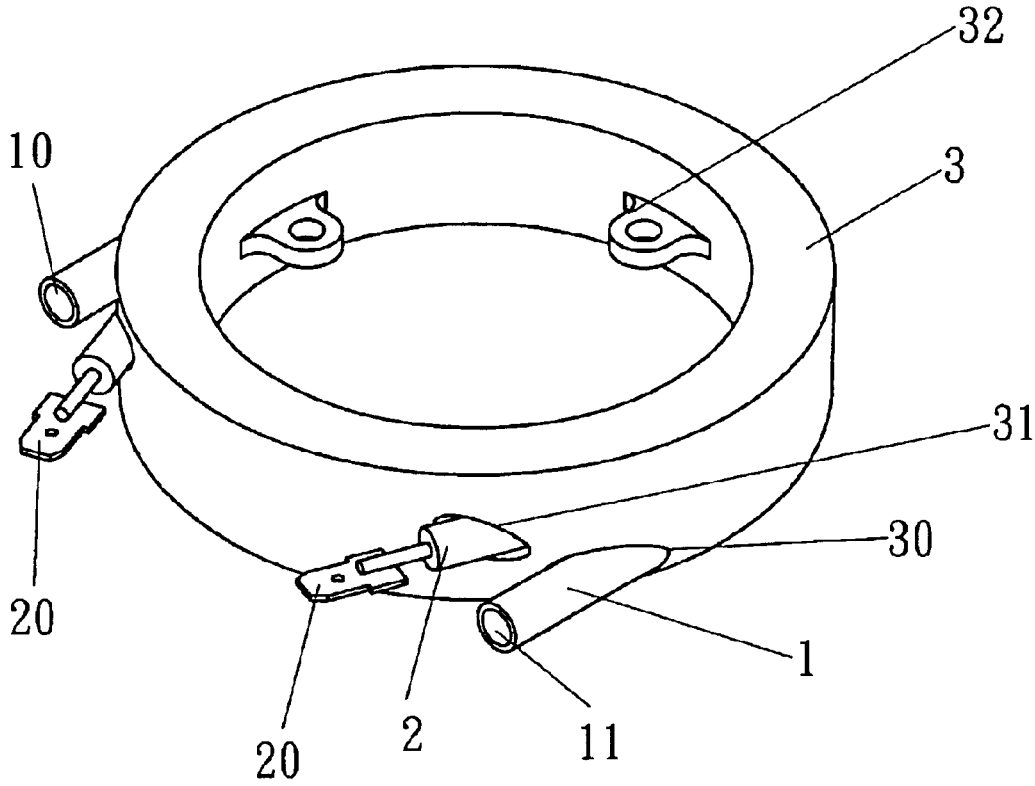
FIG. 3 is a perspective view of the water pipe and the electric heating tube combined together and having their outer side wrapped up with a support base in the present invention.

A preferred embodiment of a quick heater for drinking water in the present invention, as shown in FIGS. 1, 2 and 3, includes a water pipe 1, an electric heating tube 2, a support base 3 and a container 4 combined together.

The water pipe 1 is made of stainless steel, shaped helical and defines a narrow space 12 between two overlapped pipe portions. The water pipe 1 has one end formed with a water inlet 10 and the other end a water outlet 11.

The electric heating tube 2 of aluminum alloy is fitted in the narrow space 12 of the water pipe 1 and has its opposite ends respectively provided with a wire connecting terminal 20.

The support base 3 is wrapped around the outer side of the combined body of the water pipe 1 and the electric heating tube 2 and has its outer side bored with two insert holes 30 and two wire terminal holes 31. The two insert holes 30 are respectively for the water inlet 10 and the water outlet 11 of the water pipe 1 to extend out therethrough, while the two wire terminal holes 31 are respectively for the opposite wire connecting terminals 20 of the electric heating tube 2 to extend out therethrough. The support base 3 is further provided with plural lugs 32 spaced apart on the inner annular side.

The container 4 to be supported and positioned on the support base 3 is provided with a water intake pipe 40 and a water-releasing pipe 41. The water intake pipe 40 is connected with the water outlet 11 of the water pipe 1, and the water-releasing pipe 41 has one end extending to a position near the bottom in the container 4. Further, the container 4 has plural positioning studs 42 fixed under the bottom and matching with the lugs 32 of the support base 3.

Figure 4:
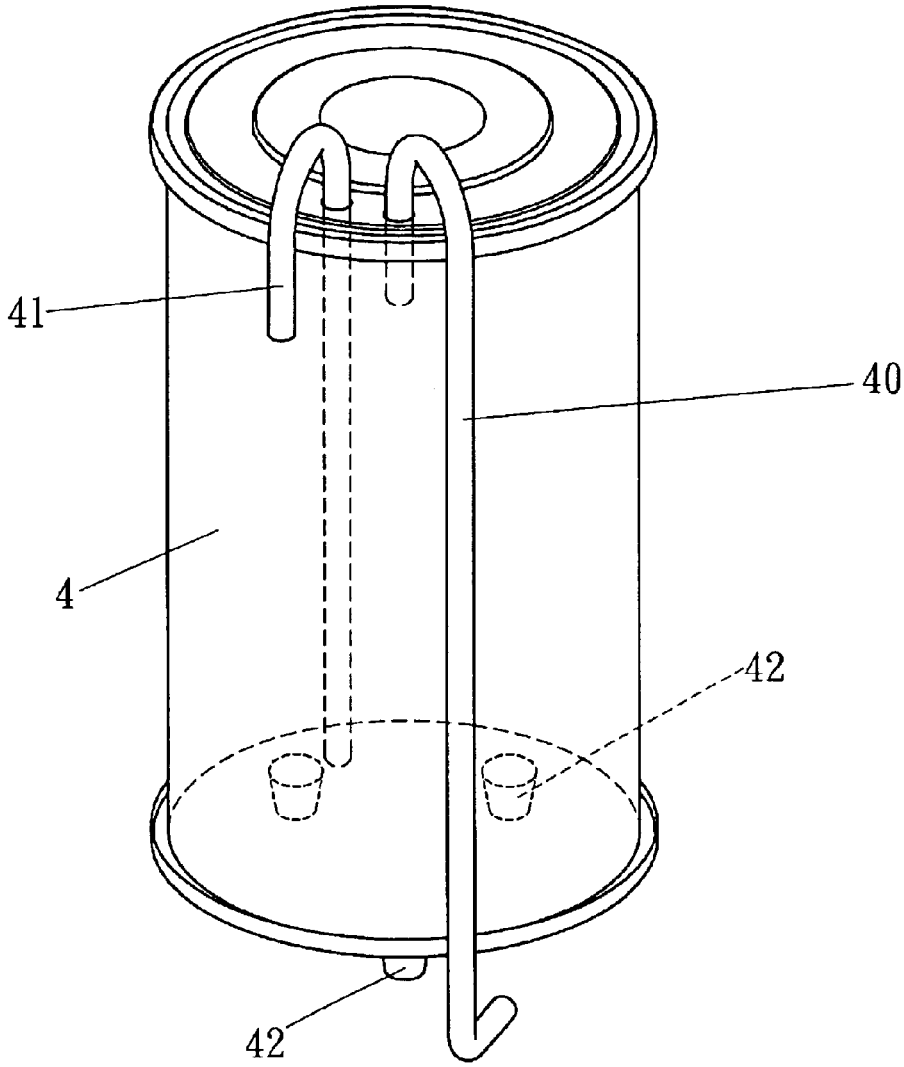
FIG. 4 is a perspective view of the support base and a container separated from each other in the present invention; and, FIG. 5 is a perspective view of the quick heater for drinking water in a using condition in the present invention.
Figure 4:
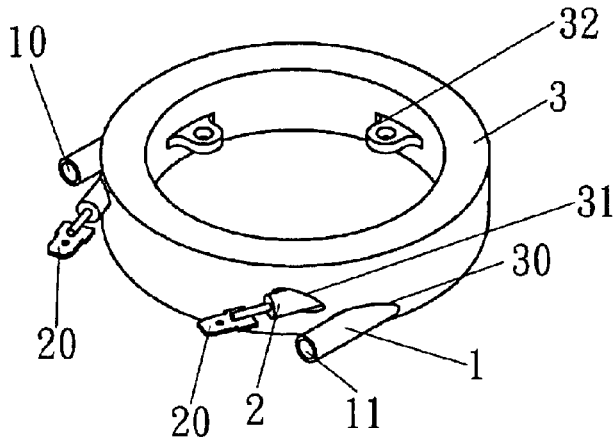
Figure 5:
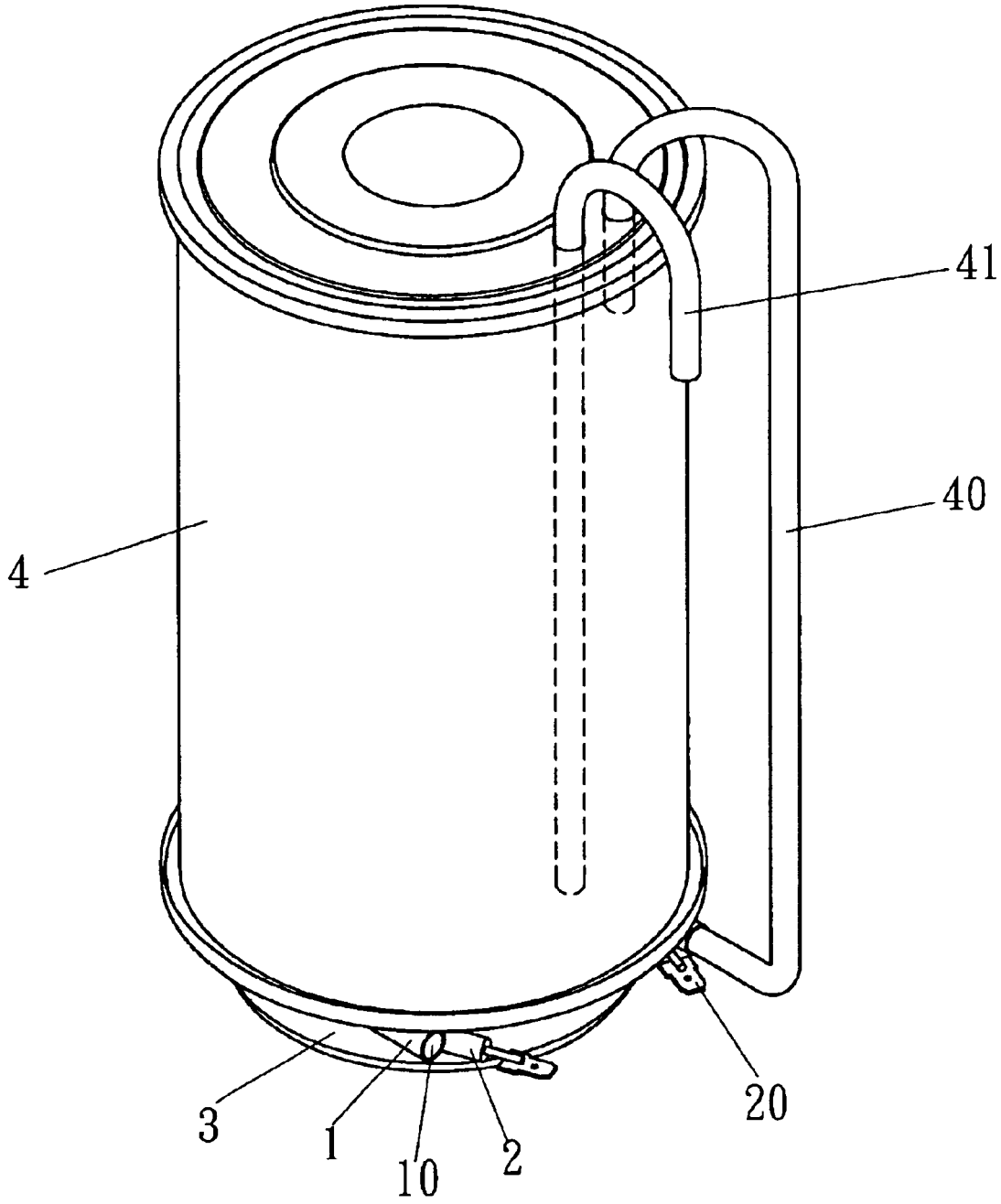

In assembling, firstly, the electric heating tube 2 is fitted in the narrow space 12 of the helical water pipe 1, as shown in FIG. 2. Then, the combined body of the water pipe 1 and the electric heating tube 2 has its outer side wrapped up with the support base 3 of aluminum alloy, letting the water inlet 10 and the water outlet 11 of the water pipe 1 respectively extend out of the two insert holes 30 and the two wire connecting terminals 20 of the electric heating tube 2 respectively extend out of the two wire terminal holes 31 of the support base 3 to be connected with an electric source, as shown in FIG. 4. Next, the container 4 is assembled on the support base 3, letting the positioning studs 42 under the bottom of the container 4 fixed on the lugs 32 of the support base 3 and the water intake pipe 40 of the container 4 connected with the water inlet 10 of the water pipe 1, as shown in FIG. 5. Thus, when cool water gets into the water pipe 1 through the water inlet 10, it will flow circularly therein and heated by the electric heating tube 2, and then the hot water is conveyed to the container 4 through the water outlet 11 of the water pipe 1 and the water intake pipe 40 of the container 4. Thus, a user can get the hot drinking water out of the container 4 for use through the water-releasing pipe 41. In addition, the drinking water in the container 4 can be kept hot all the time.

While the preferred embodiment of the invention has been described above, it will be recognized and understood that various modifications may be made therein and the appended claims are intended to cover all such modifications that may fall within the spirit and scope of the invention.

What is claimed is:

1. A quick heater for drinking water comprising:

a water pipe made of stainless steel, said water pipe having one end formed with a water inlet and the other end formed with a water outlet, said water pipe shaped helical and forming a narrow space between two overlapped pipe portions;

an electric heating tube fitted in said narrow space of said water pipe, said electric heating tube having its opposite ends respectively provided with a wire connecting terminal;

a support base wrapped around the outer side of the combined body of said water pipe and said electric heating tube, said support base having its outer side bored with two insert holes and two wire terminal holes, said two insert holes respectively for said water inlet and said water outlet of said water pipe to extend out therethrough, said two wire terminal holes respectively for said two wire connecting terminals of said electric heating tube to extend out therethrough, said support base provided with plural lugs at the inner side; and, a container assembled on said support base, said container provided with a water intake pipe and a water releasing pipe, said water intake pipe connected with said water outlet of said water pipe.

2. The quick heater for drinking water as claimed in claim 1, wherein said support base is made of aluminum alloy.

3. The quick heater for drinking water as claimed in claim 1, wherein said water releasing pipe of said container has one end extending to a location near the bottom in said container, and said container has plural positioning studs fixed under the bottom and matching with said lugs of said support base.

* * * * *